United States Patent [19]

Boehringer

[11] 4,409,884

[45] Oct. 18, 1983

[54] SYNCHRONIZATION CYLINDER

[75] Inventor: Wilfred E. Boehringer, Fullerton, Calif.

[73] Assignee: McDonnell Douglas Corporation, Long Beach, Calif.

[21] Appl. No.: 247,377

[22] Filed: Mar. 25, 1981

[51] Int. Cl.[3] ..... F01B 25/04; F15B 11/22

[52] U.S. Cl. ..... 91/17; 91/207; 91/401; 91/520; 92/108

[58] Field of Search ..... 91/171, 173, 520, 401, 91/207, 208, 209; 92/108, 52

[56] References Cited

U.S. PATENT DOCUMENTS

| | | | |
|---|---|---|---|
| 499,589 | 6/1893 | Player | 91/156 |
| 533,783 | 2/1895 | Brameld | 91/156 |
| 735,741 | 8/1903 | Forney | 91/164 |
| 1,553,022 | 8/1922 | Benson | 91/156 |
| 1,900,050 | 3/1933 | Ernst | 60/426 |
| 2,664,859 | 1/1954 | Green | 92/108 |
| 2,736,515 | 2/1956 | Dolan et al. | 244/49 |
| 2,759,330 | 8/1956 | Van Broekhoven et al. | 60/97 |
| 2,969,647 | 1/1961 | Raymond | 60/97 |
| 2,984,072 | 5/1961 | Born | 60/97 |
| 3,053,053 | 9/1962 | Douglas | 60/97 |
| 3,353,352 | 11/1967 | Gordner | 92/108 |
| 3,792,643 | 2/1974 | Scheafer | 91/411 |
| 3,855,794 | 12/1974 | Meyer et al. | 60/546 |
| 4,241,581 | 12/1980 | Chace | 60/538 |

FOREIGN PATENT DOCUMENTS

| | | | |
|---|---|---|---|
| 185998 | 3/1967 | U.S.S.R. | 91/207 |

OTHER PUBLICATIONS

Hydraulics and Pneumatics published by Penton/IPC Inc. Cleveland, OH, Feb. '74 issue @ p. 39 Hydraulics & Pneumatics published by Penton/IPC Inc., Jul. 1971 @ p. 14.

*Primary Examiner*—Paul E. Maslousky

*Attorney, Agent, or Firm*—Paul T. Loef; George W. Finch; Donald L. Royer

[57] ABSTRACT

A fluid actuator where an outside cylinder envelopes an inside cylinder producing four chambers, two for the power stroke and two for synchronization, for application where two or more cylinders are to drive a single load such that all cylinders advance at the same rate by cross plumbing synchronizing chambers. The combination is provided with valve means which opens at the end of each stroke to realign the actuators.

11 Claims, 2 Drawing Figures

SYNCHRONIZATION CYLINDER

BACKGROUND OF THE INVENTION

This invention pertains to the problem of advancing two or more hydraulic cylinders to move a single load, such that all cylinders advance at the same rate.

Synchronized movement of pairs of hydraulic cylinders is critical in certain aircraft applications. For example, aircraft flap systems are generally segmented and each segment is driven by two or more hydraulic actuators, and if the actuators are not synchronized in advance and retract the surfaces are subjected to undue stress. In some cases non-synchronization may cause the system to bind. Also the segments of the flap system must advance at the same rate. The same is true of large cargo doors. Thrust reversers in jet aircraft which retard the forward momentum of the aircraft after landing are generally operated by multiple hydraulic actuators. Thrust reverser movement must be synchronized although the loads in the individual actuators may vary. The problem, of course, is not limited to aircraft.

Synchronized movement of multiple hydraulic cylinders may be achieved by metered control of fluid flow, e.g. flow dividers and split delivery pumps. These methods must be made very complex in order to meet synchronization accuracies required. A more novel approach which inherently lends itself to the accuracies required was taught in U.S. Pat. No. 3,855,794 to Meyer et al and in an article which appeared in a periodical entitled HYDRAULICS AND PNEUMATICS published by Penton/IPC, Inc., Cleveland, Ohio in the February 1974 issue at page 39. Both of these disclosures teach using the rearward piston and that portion of the cylinder which, of course, produces two cavities which are used for the power stroke to extend and retract the piston while the front two chambers are used to synchronize the two cylinders. The two cavities of the respective synchronization cylinders are cross plumbed i.e. the front cavity of the first cylinder is plumbed to the rear cavity of the second cylinder and the second cavity of the first cylinder is plumbed to the first cavity of the second cylinder. The two cylinders must advance and retract together because of their interconnection. Of course, both cylinders must have the same bore and rod size so as to displace equal volumes of fluid for equal stroke. The problem with the apparatus of this teaching is that it requires a very long actuator and in many aircraft applications this length is simply not available.

Another article appeared in the same periodical, HYDRAULICS AND PNEUMATICS, in the July 1979 issue, at page 14, which disclosed a novel method of reducing the length of the actuator. However, one cylinder extends while the other cylinder retracts, both at the same speed, of course, and then teaches connecting the rod ends to different mechanical linkages with reversed motion. This approach may also create a space problem at the actuator end.

Another approach for synchronizing cylinders was taught in U.S. Pat. No. 4,241,581 to Chase which discloses a synchronizer which consists of a two piston pump. While this teaching does permit the two-piston pump to be located remotely from the actuator it requires a much more complex circuit, it does not inherently lend itself to dimensional control, and does not provide for any means to realign the actuator in case of internal leakage.

In summary, the teachings of the four references discussed in detail have their advantages and disadvantages. However, none of the art alone or in combination teaches how to solve the undue length of the actuator as taught in the first two references while retaining the inherent ease of maintaining the critical dimensions. None of the art teaches adequate means for adjusting the synchronization of the two cylinders because of leakage.

SUMMARY OF THE INVENTION

The present invention is two enveloping fluid cylinders enclosed in a single actuator which produces four fluid chambers. Two or more actuators are combined to drive a single load such that all cylinders advance at the same rate even though the individual cylinder loads may vary. Two of the four chambers provide the power stroke to extend and retract the cylinder piston rod. The two remaining chambers are cross-plumbed to corresponding chambers on the second actuator so that fluid actuation to the extend or retract chambers actuates the respective synchronizing chambers. Fluid is expelled from one synchronizing chamber to another synchronizing chamber and since synchronizing chambers are exactly equal in area and stroke one actuator cannot advance without the other actuator advancing as there would be no receptacle to receive the expelled fluid.

The system is further refined by further plumbing the cross plumbed synchronizing chamber through a check and relief valve means to system return so that any over pressure in the synchronizing system may be vented to return and any leakage may be replenished if the pressure in the synchronizing chamber should fall below the system return pressure.

A further valve means is provided which is actuated by the moving piston by opening the valve means to permit fluid flow between either the extend or retract chamber and one of the synchronizing chambers which realigns the two actuators at the end of each full stoke. The alignment may occur at either end of the stroke, or at both ends.

An object of the invention is to provide two or more fluid actuators to drive a single load and maintain synchronization even though the loads may vary. It is a further object of the invention to provide an actuator for the noted purpose with an end-to-end length approaching one half of that of a tandem hydraulic cylinder.

Another objective of the invention is to provide valve means to realign the two actuators at one end of each stroke and to provide means to accommodate thermal expansion of the fluid in the system.

BRIEF DESCRIPTION OF THE DRAWING

With reference to the drawings, like reference numerals designate like portions of the inventions.

DETAILED DESCRIPTION OF THE PREFERRED EMBODIMENT

Figure 1:
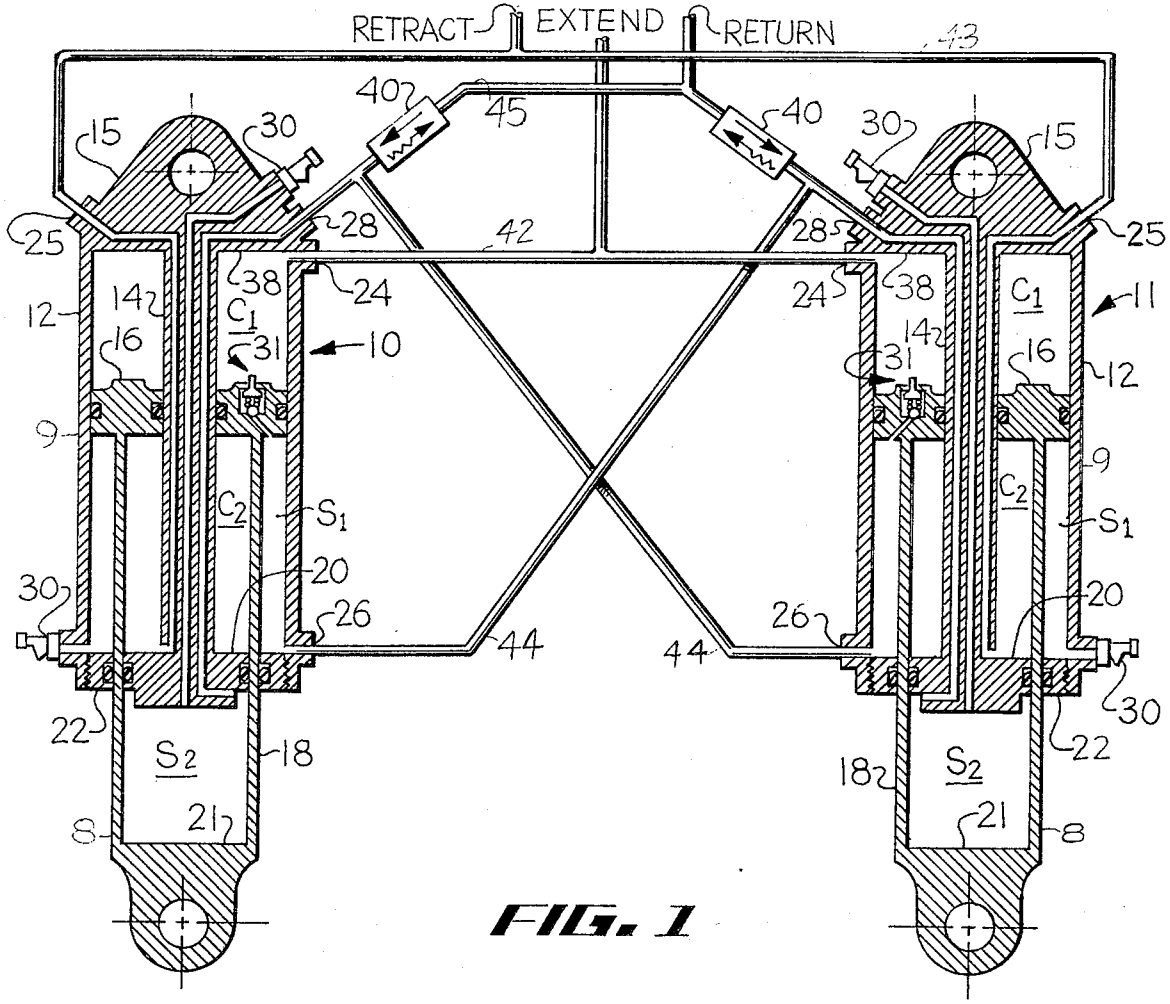
FIG. 1 is a sectional view through both actuators, shown schematically, which shows the connecting hydraulic plumbing.

Referring in detail to the drawing of FIG. 1, a pair of actuators 10 and 11 are shown which are essentially identical. One actuator consists, essentially, of an outside cylinder, 9, which envelopes an inside cylinder 8. The actuator consists of an outside cylinder barrel 12 having an internal tail rod 14 which is integrally connected to the tail cap end 15 of the outside cylinder barrel 12. Moving piston 16 rides in the inside diameter of the outside cylinder barrel 12 and circumscribes the internal tail rod 14 to form an extend chamber $C_1$. Attached to the moving piston 16 is the inside cylinder barrel 18 which also functions as the piston rod for piston 16 and circumscribes the fixed piston 20. Fixed piston 20 in turn attaches to the end of the internal tail rod 14 to also function as a fixed piston rod for the fixed piston 20 and form a chamber, $C_2$ formed between the inside diameter of the inside cylinder barrel 18 and the outside surface of the internal tail rod 14 and the two opposing faces of the moving and fixed pistons 16 and 20. Another chamber is formed between the fixed piston 20 and the inside cylinder barrel closed end 21 which is identified as $S_2$. The head end cap 22 closes the bore in the outside cylinder barrel 12 and circumscribes, the inside cylinder barrel 18, which functions as the, piston rod for piston 16 to form the fourth chamber identified as $S_1$. The chambers $C_1$ and $C_2$ are the power stroke chambers to extend and retract the piston rod while the chambers $S_1$ and $S_2$ form the synchronization chambers which are equal in piston area and stroke.

Now, the pressurized fluid power supply is connected to first ports 24 via conduit 42 for external or alternately to second ports 25 via conduit 43 for retract through appropriate valving (not shown) to supply the power stroke for both cylinders. One set of the ports, of course, is alternately connected to return. Correspondingly, the third port 26 of the actuator 10 is connected to the third port 28 of the actuator 11 by conduit 44, while the fourth port 26 of the actuator 11 is connected to the third port 28 of actuator 10 by its conduit 44. In other words, the synchronization chambers are cross-plumbed in the paired actuators 10 and 11, i.e. synchronization chamber $S_1$ for acutator 10 is connected to synchronization chamber $S_2$ of actuator 11, while synchronization chamber $S_1$ of actuator 11 is connected to synchronization chamber $S_2$ of actuator 10. In order for the piston 16 to extend the barrel 18, the fluid in the chamber $S_1$ must expel into the synchronization chamber $S_2$ of the opposing actuator and in order for the piston 16 to retract, the synchronization chamber $S_2$ must expel into the synchronization chamber $S_1$ of the opposing actuator thereby synchronizing the motion of the two cylinders.

Bleed and fill valves 30 are provided for each synchronization cylinder as it is essential that all air be bled from the system as the systems are dead ended.

A synchronization valve 31 is provided inside the cylinder shown in the moving piston 16 comprised of a poppet 32, (See FIG. 2) a poppet seat 33, a biasing spring 34, a ball 35 and a ball seat 36. The synchronization vlave 31 is provided to realign the acutators after each actuation. As the piston 16 retracts and bottoms against the surface 38, the poppet 32 unseats by compressing the spring 34 and if the pressure in the $S_1$ chamber is higher than the $C_1$ chamber, fluid will flow from chamber $S_1$ to $C_1$ as the ball 35 will unseat because of differential pressure. An out of sync condition could occur if there were leakage past the seals. While the synchronization valve 31 is shown in the piston 16 so as to synchronize on the return stroke, it could be located in the piston 20 so as to synchronize on the extend stroke.

Further, the synchronization chambers $S_1$ and $S_2$ of actuators 10 and 11, respectively, have been plumbed to the return line 45 through a check and relief system 40 to assure that the synchronization system is always full of fluid and provide a thermal relief path to accommodate fluid expansion due to heat. The check valve function is conventional and if any synchronization chamber exceeds a predetermined pressure it will be relieved through the system 40. Additionally, should either of the synchronization chambers, for some reason, lose fluid and the chamber pressure drop below the return pressure, fluid will flow from the return line 45 to the synchronization chamber through the check portion of the check and relief system 40. In aircraft systems the return line is maintained at a positive pressure, usually in the range of 50 or 60 psi.

Figure 2:
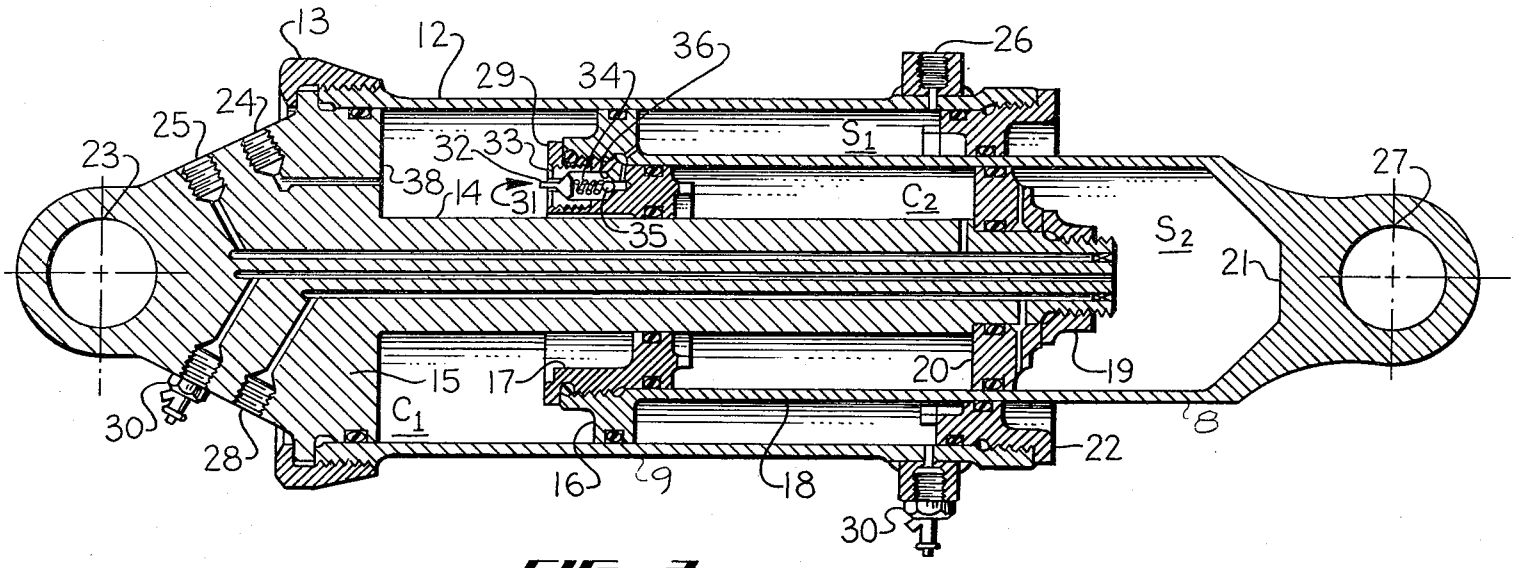
FIG. 2 is a detailed view of an actual embodiment of the acutator.

An embodiment of the actuator shown as 10 and 11 in FIG. 1 is shown in FIG. 2. Secured in the outside cylinder barrel 12 by the shoulder nut 13 is the internal tail rod 14 which is integral with the end cap 15. Moving piston, and the only moving piston, is shown as a gland 17 which combines with the hollow inside cylinder barrel 18 whose end portion terminates in a skirt to form the piston 16 which slideably engages the inside diameter of the outside cylinder barrel 12. Attached to the end of the internal tail rod 14 is the fixed piston 20 which is retained by the nut 19. Piston 20, while stationary, slideably engages the inside diameter of the outside cylinder piston rod or inside cylinder barrel 18 which terminates in the inside cylinder barrel closed rod end 21 which completes the inside cylinder. The head end cap 22 closes the open end of the outside cylinder barrel 12 to form a second fluid cylinder which envelopes the first fluid cylinder. The inside fluid cylinder has the cavities $C_2$ and $S_2$ while the outside fluid cylinder has the cavities $C_1$ and $S_1$.

The cap end 15 terminates in a suitable actuator support means shown as a bore 23 and accommodates the extend and retract ports 24 and 25 and the synchronization or second extend port 28 along with the bleed valve 30 to bleed the chamber $S_2$. The outside cylinder barrel 12 has an alternate synchronization or second retract port at 26 and a bleed valve at 30 for bleeding the chamber $S_1$. These ports are shown as bosses on the cylinder 12. Piston rod 18 also terminates in a suitable attachment at the rod end shown as a bore 27.

Enclosed in the gland 17 portion of the first piston 16 is a synchronization valve 31. The valve consists of a poppet 32 which projects above the end surface 29 of the first piston 16, is biased against the seat 33 which threads into the gland 17 by the spring 34 which also biases the ball 35 against its seat 36. Again, the function of the synchronization valve 31 is to open when the first piston 16 reaches the end of its stroke against the surface 38 by unseating the poppet 32. At this point the chamber pressure $C_1$ is return system pressure and if the chamber $S_1$ exceeds return pressure fluid may flow from $S_1$ to $C_1$ to return and thereby synchronize the actuators when used as shown in FIG. 1.

It is not intended to limit this invention to the embodiment disclosed above, but all changes and modifications thereof not constituting deviation from the spirit and scope of the invention are intended to be included.

What is claimed is:

1. A synchronized fluid actuator system comprising:

at least first and second actuator units, each actuator unit further comprising:

(a) an outside fluid cylinder having one closed end with an internal tail rod which terminates in a fixed piston smaller in diameter than the inside diameter of said outside fluid cylinder;

(b) a moving piston which slideably engages said inside diameter of said outside fluid cylinder while having an inside bore which slideably engages said internal tail rod, thereby forming a variable extend chamber which when pressurized with fluid extends said moving piston;

(c) an inside fluid cylinder having an outside diameter which produces an area which when subtracted from the area of said moving piston leaves an area equal to the area of said fixed piston, one closed end, the opposing end attached to said moving piston and an inside diameter which slideably engages said fixed piston, thereby forming a variable retract chamber between said piston surfaces and said inside cylinder and a secondary synchronizing chamber between said one closed end of said inside cylinder and said fixed piston;

(d) a head end cap closing the open end of said outside fluid cylinder while allowing axial displacement of said inside fluid cylinder thereby forming a primary synchronization chamber equal and opposite in volumetric displacement with said secondary synchronizing chamber;

(e) a first port communicating with said extend chamber;

(f) a second port communicating with said retract chamber;

(g) a third port and a fourth port communicating to said secondary and primary synchronizing chambers respectively;

(h) means to synchronize said at least first and second actuators at one end stroke of each of said moving pistons;

first conduits inter-connecting said first ports and connecting said interconnected first ports, alternately, to a fluid power source for extend stroke and system return for retract stroke;

second conduits interconnecting said second ports and connecting said interconnected second ports, alternately, to system return for extend stroke and to a fluid power source for retract stroke;

third conduits interconnecting said third port of said first actuator with the fourth port of said second actuator; and fourth conduits interconnecting said fourth port of said first actuator with the third port of said second actuator whereby fluid actuation of said extend or retract chambers actuates the respective synchronizing chambers so that fluid expelled from said primary synchronizing chamber of one actuator unit is admitted to said secondary synchronizing chamber of said second actuator unit and vice versa which synchronizes the actuation of said at least two actuator units even though their loads may be unequal.

2. The system of claim 1 wherein each actuator unit is provided bleed ports and valves communicating to each of said synchronizing chambers.

3. The system of claim 1 wherein each of said third and fourth conduits are further connected through check and relief valve means to said system return whereby any overpressure in the synchronizing system may be vented to return and any leakage may be replenished if the pressure in the synchronizing chambers falls below the system return pressure.

4. The system of claim 3 wherein said means to synchronize said at least first and second actuators comprises valve means actuated by each of said moving pistons for synchronizing said cylinder units at either end of the full excursion of said moving piston by permitting fluid flow between one of said extend and retract chambers with one of said synchronizing chambers.

5. The system of claim 4, in which the synchronizing valve means comprises:

(a) two opposing valve seats in spaced relationship located in said moving piston, the first of said seats communicating with said extend chamber and the second of said valve seats communicating with said primary synchronization chamber;

(b) a poppet locted in said first seat having an extension which projects into said extend chamber;

(c) a ball located in said second seat; and (d) spring biasing means between said poppet and said ball.

6. A synchronized fluid actuator system comprising:

at least first and second actuator units, each actuator unit further comprising:

(a) an inside fluid cylinder having an inside cylinder barrel, a fixed piston slideably engaging said cylinder barrel, an internal tail rod, which also functions as a piston rod, attached to said fixed piston, said inside cylinder barrel having one closed end which functions as the tail end cap and having the second end enlarged to form a moving piston having an inside diameter which slideably engages said tail rod so as to function as a head end cap whereby forming a secondary synchronizing chamber between said fixed piston and said closed end of said inside cylinder barrel and a retract chamber between said fixed piston and said moving piston;

(b) an outside fluid cylinder enveloping said inside cylinder, having an outside cylinder barrel with the inside diameter slideably engaging said moving piston, a head end cap enveloping said inside cylinder barrel so that said inside cylinder barrel becomes the piston rod of said moving piston, a tail end cap closing said outside cylinder barrel and attached to said internal tail rod whereby forming an extend chamber and a primary synchronizing chamber, and further, said primary synchronizing chamber has an area exactly equal to said secondary synchronizing chamber;

(c) a first port communicating with said extend chamber;

(d) a second port communicating with said retract chamber;

(e) a third and a fourth ports ccommunicating to said secondary synchronizing chamber and said primary synchronizing chamber repsectively;

(f) means to synchronize said at least two actuators at one end stroke of each of said moving pistons;

first conduits inter-connecting said first ports and connecting said interconnected first ports, alternately, to a fluid power source for extend stroke and system return for retract stroke;

second conduits interconnecting said second ports and connecting said interconnected second ports, alternately, to system return for extend stroke and to a fluid power source for retract stroke;

third conduits interconnecting said third port of said first actuator with the fourth port of said second actuator; and fourth conduits interconnecting said fourth port of said first actuator with the third port of said second actuator whereby fluid actuation of said extend or retract chamber actuates the respective synchronizing chambers so that fluid expelled from said primary synchronizing chamber of one actuator unit is admitted to said secondary synchronizing chamber of said second actuator unit and vice versa which synchronizes the actuation of said at least first and second actuator units even though their loads may be unequal.

7. The system of claim 6 wherein each of said third and fourth conduits are further connected through check and relief valve means to said system return.

8. The system of claim 7 wherein said means to synchronize said at least first and second actuators comprises valve means actuated by each of said moving pistons for synchronizing said actuator units at either end of the full excursion of each of said moving piston by permitting fluid flow between one of said extend and said retract chambers and one of said synchronizing chambers.

9. A four cavity fluid cylinder comprising:

an inside fluid cylinder having an inside cylinder barrel, a fixed piston slideably engaging said inside cylinder barrel, an internal tail rod which also functions as a piston rod attached to said fixed piston, said inside cylinder barrel having one closed end which functions as the tail end cap, and having the second end enlarged to form a moving piston havng an inside diameter which slideably engages said tail rod so as to function as a head end cap whereby forming a secondary synchronizng chamber between said fixed piston and said closed end of said inside cylinder barrel and a retract chamber between said fixed piston and said moving piston;

an outside fluid cylinder enveloping said inside fluid cylinder, having an outside cylinder barrel with the inside diameter slideably engaging said moving piston, a head end cap enveloping said inside cylinder barrel formed so that said inside cylinder barrel becomes the piston rod of said moving piston, a tail end cap closing said outside cylinder barrel and attached to said internal tail rod whereby forming a cylinder unit having four chambers, two to extend and retract the moving piston and two synchronizing chambers;

ports adapted for connection with said four chambers for fluid communication; and valve means actuated by said moving piston at either stroke end, permitting fluid flow between one of said extend or said retract chambers and one of said synchronizing chambers.

10. The fluid cylinder of claim 9 wherein said valve means is a valve situated in said moving piston and actuated by said moving piston reaching the end of its stroke so as to permit fluid communication between one of said extend or said retract chambers and one of said synchronizng chambers.

11. A four cavity fluid actuator comprising:

an outside cylinder barrel having one closed end to form a head end cap with an internal tail rod attached which terminates in a fixed piston smaller in diameter than the inside diameter of said outside fluid cylinder;

a moving piston which slideably engages said inside diameter of said outside fluid cylinder barrel while having an inside bore which slideably engages said internal tail rod, thereby forming a variable extend chamber which when pressurized with fluid extends said moving piston;

an inside cylinder barrel having one closed end, the opposing end attached to said moving piston and having an inside diameter which slideably engages said fixed piston, thereby forming a variable retract chamber defined by surfaces of said moving and fixed pistons said inside cylinder barrel and a secondary synchronizing chamber between said one closed end of said inside cylinder and said fixed piston;

a head end cap closing the open end of said outside fluid cylinder barrel while allowing axial displacement of said inside fluid cylinder barrel and said moving piston, thereby forming a primary synchronization chamber between said head end cap and said moving piston and the inside of said outside cylinder barrel and the outside of said inside cylinder barrel;

ports adapted for fluid connection with said chambers; and valve means actuated by said moving piston, at stoke end and permitting fluid flow between said extend chamber of said primary synchronizing chamber or said retract chamber and said secondary synchronizing chamber.

* * * * *